US005816121A

United States Patent [19]

Yoshimizu et al.

[11] Patent Number: 5,816,121

[45] Date of Patent: Oct. 6, 1998

[54] CORDLESS FASTENING TOOL

[75] Inventors: Chikai Yoshimizu; Yasusi Anzo, both of Ibaraki, Japan

[73] Assignee: Hitachi Koki Co., Ltd., Tokyo, Japan

[21] Appl. No.: 853,747

[22] Filed: May 9, 1997

[30] Foreign Application Priority Data

May 10, 1996 [JP] Japan ..... 8-116396

[51] Int. Cl.[6] ..... B25B 21/00

[52] U.S. Cl. ..... 81/469; 173/176

[58] Field of Search ..... 81/467, 469; 173/176

[56] References Cited

U.S. PATENT DOCUMENTS 4,215,594 8/1980 Workman, Jr., et al. .

4,883,130 11/1989 Dixon ..... 81/467 X 5,490,439 2/1996 Matsumura et al. ..... 81/469

FOREIGN PATENT DOCUMENTS 57-048348 10/1982 Japan .

*Primary Examiner*—James G. Smith

*Attorney, Agent, or Firm*—Pollock, Vande Sande & Priddy

[57] ABSTRACT

A speed-increasing mechanism and a clutch mechanism are provided between a speed-reduction gear train and planetary gear trains, to realize a small-torque and high-speed rotation during a light load condition and a large-torque and low-speed rotation during a heavy load condition. A motor is actuated by a relay. An auxiliary motor switch, closing a contact of the relay, is provided at a motor housing to facilitate an operation of a shear wrench during a work where a bolt is fastened upward from below.

9 Claims, 11 Drawing Sheets

CORDLESS FASTENING TOOL

BACKGROUND OF THE INVENTION

1. Field of the Invention

This invention relates to a cordless fastening tool, such as a nut runner or a shear wrench, that is used, for example, for fastening steel plates to form a steel frame in the construction site for a building, a bridge or the like. Especially, the present invention preferably applied to a cordless shear wrench.

2. Related Art

FIG. 9 shows a shear bolt that is used for fastening the steel members. A bolt 1 of M16 to M24 is formed with at its tip with a chip 3. A steel plate assembly 6 is sandwiched between a nut 4 and a head 5 of bolt 1. When the bolt 1 is tightened by a shear wrench, the nut 4 is held by an outer socket of the shear wrench, while the chip 3 is held by an inner socket thereof. Then, the bolt 1 is tightened with a large torque of 300 to 1,000 Nm. The chip 3 has a constricted or neck portion 8 that is set to be wrenched off with a uniform shearing torque so as to ensure a predetermined tightening torque to be applied to the bolt 1.

SUMMARY OF THE INVENTION

A principal object of the present invention is to provide an improved fastening tool.

An object of the present invention is to provide a shear wrench capable of adequately changing the rotational speed of sockets in accordance with a load acting thereto.

An object of the present invention is to provide a shear wrench easy to handle during a bolt fastening operation, especially during a work where a bolt is fastened upward from below.

An object of the present invention is to increase a rotational speed of a nut during a no-load condition.

Another object of the present invention is to reduce the size of a motor switch actuating the motor.

Still another object of the present invention is to dispose the motor switch near a motor housing.

In order to accomplish above-described and other related objects, the present invention provides a novel and excellent shear wrench having various aspects which will be described hereinafter with reference to numerals in parentheses which show the correspondence to the components described in the preferred embodiments of the present invention described later.

Reference numerals in parentheses, added in the following description, are merely used for the purpose of helping the understanding to the present invention and not used for narrowly interpreting the scope of claims of the present invention.

More specifically, a first aspect of the present invention provides a cordless shear wrench comprising a motor (9) driven by a battery (28), a speed-reduction gear train (10–13) and a plurality of planetary gear trains (15–17, 41, 44–47) reducing the rotational speed of the motor (9) and transmitting the rotation of the motor (9) to a socket unit (2, 7) rotating and fastening a bolt with an associated nut. Furthermore, a speed-increasing gear mechanism (55, 56, 60) with a one-way clutch (63) is added. An input member (55) of the speed-increasing gear mechanism (55, 56, 60) is connected via the one-way clutch (63) to an output member (60) of the speed-increasing gear mechanism (55. 56, 60). And, a clutch mechanism (57–59) is provided to allow a slip at a predetermined portion in the speed-increasing gear mechanism (55, 56, 60) when a load exceeds a predetermined value, thereby transmitting no torque to the output member (60) from the input member (55) through the speed-increasing mechanism (55, 56, 60).

According to the first aspect invention, the speed-increasing mechanism (55, 56, 60) is provided somewhere in the gear train connecting the motor (9) to the socket unit (2, 7). This speed-increasing mechanism (55, 56, 60) is automatically switched by the function of the clutch mechanism (57–59) between a small-torque and high-speed rotation during a light load condition and a large-torque and low-speed rotation during a heavy load condition.

Preferably, the speed-increasing gear mechanism (55, 56, 60) is interposed between a final stage gear (13) of the speed-reduction gear train (10–13) and a first stage planetary gear train (41, 15, 44) of the plurality of planetary gear trains (15–17, 41, 44–47).

Preferably, the speed-increasing gear mechanism (55, 56, 60) is constituted by a planetary gear mechanism comprising planetary gears (55) supported by a drive shaft (53) of the final stage gear (13) of the speed-reduction gear train (10–13), and a sun gear (60) formed integral with a sun gear (41) of the first stage planetary gear train (41, 15, 44), and the sun gear (60) serves as the output member of the speed-increasing mechanism (55, 56, 60).

The one-way clutch (63) may be a spring clutch having one end engaged with the drive shaft (53) and the other end engaged with the sun gear (41) of the first stage planetary gear train (41, 15, 44).

The clutch mechanism (57–59) may comprise a ball (58) brought into contact with an outer periphery of an internal gear (56) of the planetary gear mechanism constituting the speed-increasing gear mechanism (55, 56, 60), and a push spring (59) resiliently urging the ball ((58) toward the internal gear (56).

The clutch mechanism may comprise a rod (66) engageable with a recess (64) formed on an internal gear (56) of the planetary gear mechanism constituting the speed-increasing gear mechanism (55, 56, 60), a spring (67) urging the rod (66) toward the recess (64), and a solenoid coil (65) disengaging the rod (66) from the recess (64) against a resilient force of the spring (67).

In this case, the solenoid coil (65) is activated in response to a predetermined value of current flowing across the motor (9), or a predetermined value of a torque or a rotational speed of any one selected from the group consisting of the motor (9), the speed-reduction gear train (10–13) and the plurality of planetary gear trains (15–17, 41, 44–47).

A second aspect of the present invention provides a cordless shear wrench characterized by the following features. A handle (14) has a lower part configured into a bore (33) for receiving a battery (28) and a hollow space for accommodating a first motor switch (19) therein for opening or closing a power feed circuit connecting a motor (9) and the battery (28). A motor housing (24) is disposed in front of the handle (14) and extends parallel to the handle (14) for accommodating the motor (9) therein. A gear cover (40) is disposed above the handle (14) and the motor housing (24) and accommodates a speed-reduction gear train (10–13) therein. An output mechanism section (43) is provided in front of the gear cover (40) and comprises a plurality of planetary gear trains (15–17, 41, 44–47). An inner socket (2) and an outer socket (7) hold and fasten a bolt and an associated nut by using a torque transmitted from the output mechanism section (43). Furthermore, a relay (70) is provided between the motor (9) and the battery (28). The relay (70) is energized or deenergized by the first motor switch (19) and a second motor switch (71) connected in parallel with each other. And, the second motor switch (71) is provided in the motor housing (24).

According to the second aspect invention, activation of the motor (9) is controlled by the relay (70). This is advantageous to reduce the size and capacity of the motor switches (19, 71) as well as the lead.

A third aspect of the present invention provides a shear wrench comprising a motor (9), a speed-reduction gear train (10–13) and a plurality of planetary gear trains (15–17, 41, 44–47) reducing the rotational speed of the motor (9) and transmitting the rotation of the motor (9) to a socket unit (2, 7) rotating and fastening a bolt and an associated nut. Furthermore, a speed-increasing gear mechanism (55, 56, 60) with a one-way clutch (63) is added. An input member (55) of the speed-increasing gear mechanism is connected via the one-way clutch (63) to an output member (60) of the speed-increasing gear mechanism. And, a clutch mechanism (57–59) is provided to allow a slip at a predetermined portion in the speed-increasing gear mechanism (55, 56, 60) when a load exceeds a predetermined value, thereby transmitting no torque to the output member (60) from the input member (55) through the speed-increasing mechanism (55, 56, 60).

Accordingly, the present invention can be applied to a corded shear wrench as well as a cordless wrench.

BRIEF DESCRIPTION OF THE DRAWINGS

The above and other objects, features and advantages of the present invention will become more apparent from the following detailed description which is to be read in conjunction with the accompanying drawings, in which:

FIGS. 17A and 17B are cross-sectional views cooperatively showing an essential part of a speed-increasing mechanism in accordance with another embodiment of the present invention, wherein FIG. 17A is a cross-sectional view taken along a line C—C of FIG. 17B.

DESCRIPTION OF THE PREFERRED EMBODIMENTS

Figure 12:
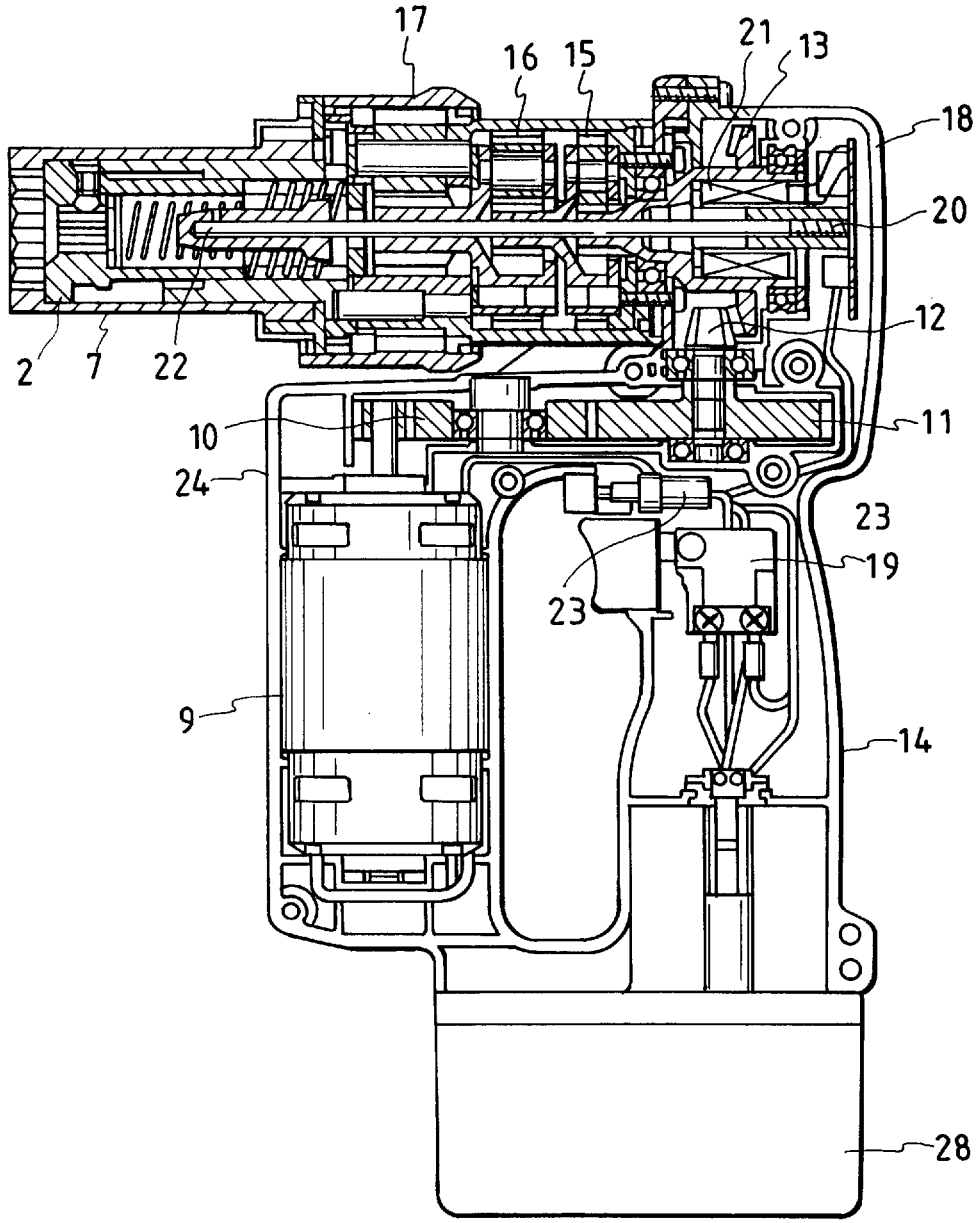
FIG. 12 is a cross-sectional view showing another cordless shear wrench previously proposed by the same applicant.

FIG. 12 shows a cordless shear wrench proposed previously by the same applicant and filed as U.S. patent application Ser. No. 08/601,348 (corresponding to German Patent Application No. 19605827.9). According to this cordless shear wrench, a battery 28 is detachably attached on the lower part of a handle 14. A motor 9 is driven by the battery 28. The rotational speed of motor 9 is reduced to about $1/2{,}400$ through spur gears 10, 11 and three-stage planetary gear trains. A large fastening torque of 300 to 1,000 Nm is thus transmitted between the inner socket 2 and the outer socket 7. An output section of the shear wrench comprises the sockets 2 and 7, the planetary gear trains and bevel gears 12 and 13. A motive power section comprises a motor 9. The handle 14 protrudes downward from the rear end 18 of the output section to connect the output section and the motive power section.

A motor switch (i.e., main switch) 19 is provided in the handle 14 for opening or closing a power feed circuit connecting the motor 9 and the battery 28. A chip switch (i.e., sub switch) 23 is also provided in the handle 14 for effecting a chip expelling mechanism that expels a wrenched-off chip 3 left in the inner socket 2. More specifically, a solenoid coil 21 is provided behind the bevel gear 13. A plunger 20 is slidably inserted in the solenoid coil 21. A rod 22 is integral with the plunger 20 and extends forward (left in FIG. 12). When the solenoid coil 21 is energized, the plunger 20 is attracted by the magnetic force of solenoid coil 21. Thus, the rod 22 advances forward and pushes or expels the wrenched-off chip 3 out of the socket 2.

Figure 13:
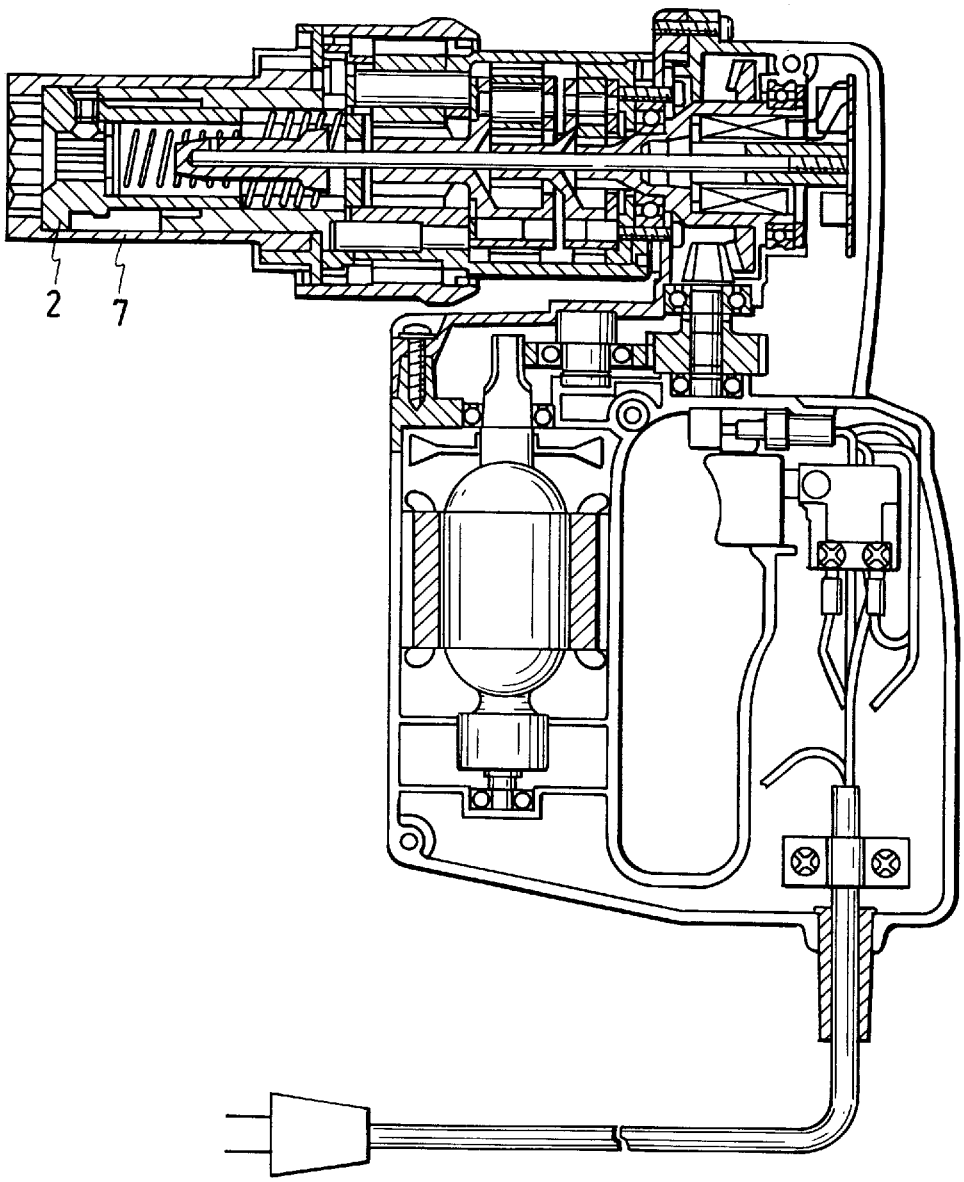
FIG. 13 is a cross-sectional view showing a corded shear wrench.

FIG. 13 shows a corded shear wrench that has a series-wound, commutator motor driven by a commercial power voltage 100 V fed via a long power cord of 30–60 m. An operation of this corded shear wrench is basically identical with that of the above-described cordless shear wrench.

However, there are various differences in performance between a cordless shear wrench and a corded shear wrench from the following principles.

1. A cordless shear wrench takes a long time to rotate a nut in a no-load condition because of its low rotational speed.

A corded shear wrench can obtain a large input power due to a high voltage fed from the commercial power source. For example, when a current value is 12 A, an available input power is about 1,200 W=100 V×12 A. Thus, an output power of the motor in the corded shear wrench becomes large.

On the other hand, according to the present-days techniques, a battery practically installable in a cordless shear wrench is limited to the 24 V in voltage and to 2 Ah in capacity. In considering burning of the motor or welding at the switching contacts, an allowable current limit is about 30 A at 24 V. Thus, an allowable input power limit for the motor in a cordless shear wrench is about 720 W=24 V×30 A, that is 60% of that of the above-described corded shear wrench. In other words, the motor of the cordless shear wrench is powerless by about 40% compared with the motor of the corded shear wrench which is applied with AC 100 V.

For the cordless shear wrench, to achieve the same magnitude of torque as that of the corded shear wrench, it is necessary to increase a speed reduction ratio from conventional 1/1,500 to 1/2,400 (i.e., 1.6 times the conventional speed reduction ratio). Accordingly, the rotational speeds of inner and outer sockets 2 and 7 of a cordless shear wrench are smaller than those of a corded shear wrench.

Figure 10:
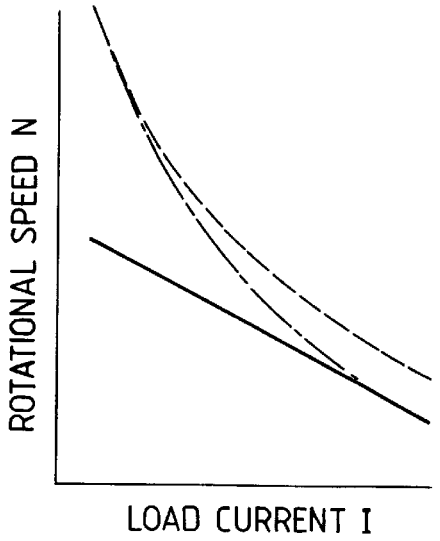
FIG. 10 is a graph showing a relationship between a motor rotational speed and a load current.
Figure 11:
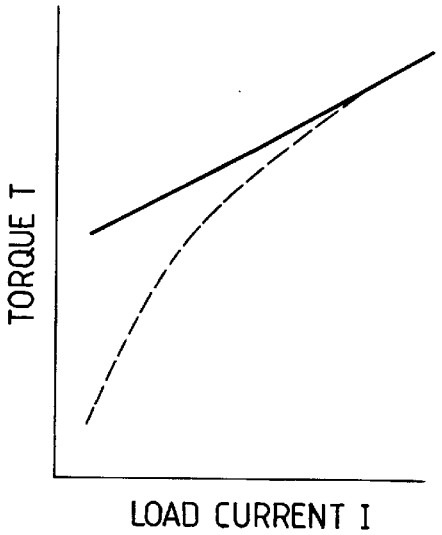
FIG. 11 is a graph showing a relationship between a motor torque and a load current.

Furthermore, there is a significant difference in the motor structure between a cordless shear wrench and a corded shear wrench. More specifically, a motor used for a cordless shear wrench is a type having a permanent magnet for a magnetic field, that is generally classified into a separately excited motor. The strength of the magnetic field is determined by the permanent magnet and is constant. Thus, in the cordless shear wrench motor, the relationship between a load current and a rotational speed is expressed by a straight line descending linearly to the right, as shown by a solid line in FIG. 10. Meanwhile, the relationship between the load current and a torque is expressed by a straight line ascending linearly to the right, as shown by a solid line in FIG. 11.

On the other hand, according to a motor of a corded shear wrench, its field winding is connected in series with its armature winding. Therefore, the strength of the magnetic field varies depending on the load current. In the corded shear wrench motor, the relationship between the load current and the rotational speed is expressed by a curved line descending quadratically to the right, as shown by a dotted line in FIG. 10. Meanwhile, the relationship between the load current and the torque is expressed by a curved line ascending quadratically to the right, as shown by a dotted line in FIG. 11. As apparent from FIGS. 10 and 11, a difference in the rotational speed between a no-load rotation and a loaded rotation is large in the corded shear wrench compared with that of the cordless shear wrench.

Furthermore, according to a cordless shear wrench, the length of a lead connecting battery 28 and motor 9 is constant and is as short as several tens cm.

On the other hand, the corded shear wrench is subjected to a large voltage drop in the long power cord of 30–60 m. This voltage drop increases with increasing load current. Therefore, the actual rotational speed of the corded shear wrench varies more drastically as shown by an alternative long and short dash line in FIG. 10. Hence, the difference in the rotational speed between a no-load rotation and a loaded rotation becomes larger in the corded shear wrench.

In a fastening operation of nut 4 by the shear wrench, a bolt 1 is usually set beforehand in through holes of the steel plate assembly 6. The head 5 of bolt 1 is attached to one side surface of the steel plate assembly 6. A washer 4*a* and the nut 4 are coupled with the opposite end of bolt 1 and screwed up by an operator's hand until the washer 4*a* and nut 4 are tightly attached to the other side surface of the steel plate assembly 6.

However, such a temporarily fastening operation completely depends on each operator and is usually imperfect or incomplete. Thus, there is a strong likelihood that the nut 4 is in a floating condition by an amount equivalent to one screw pitch.

A permanent fastening operation is then performed by the shear wrench, after the temporary fastening operation by an operator's hand is finished. In this case, the shear wrench needs to rotate for a while under a no-load condition due to the above-described floating condition of the nut 4. For a corded shear wrench that has a rotational speed as low as 25 rpm, it takes about 2.5 seconds to fasten the nut 4 by the amount equivalent to the above-described floating condition. Meanwhile, in a cordless shear wrench, its no-load rotational speed is as small as 10 rpm. Therefore, for the cordless shear wrench, it takes 6 seconds to fasten the nut 4 by the same amount.

After the nut 4 is firmly brought into contact with the steel plate assembly 6, the permanent fastening operation under a loaded condition is done by turning the nut about 90 degrees. It takes about 4 sec for each of the cordless shear wrench and the corded shear wrench. Accordingly, for the corded shear wrench, it takes 6.5 seconds for completing one cycle starting from the temporary fastening operation and ending by the permanent fastening operation under the loaded condition. On the other hand, for the cordless shear wrench, it takes 10 seconds.

Figure 8:
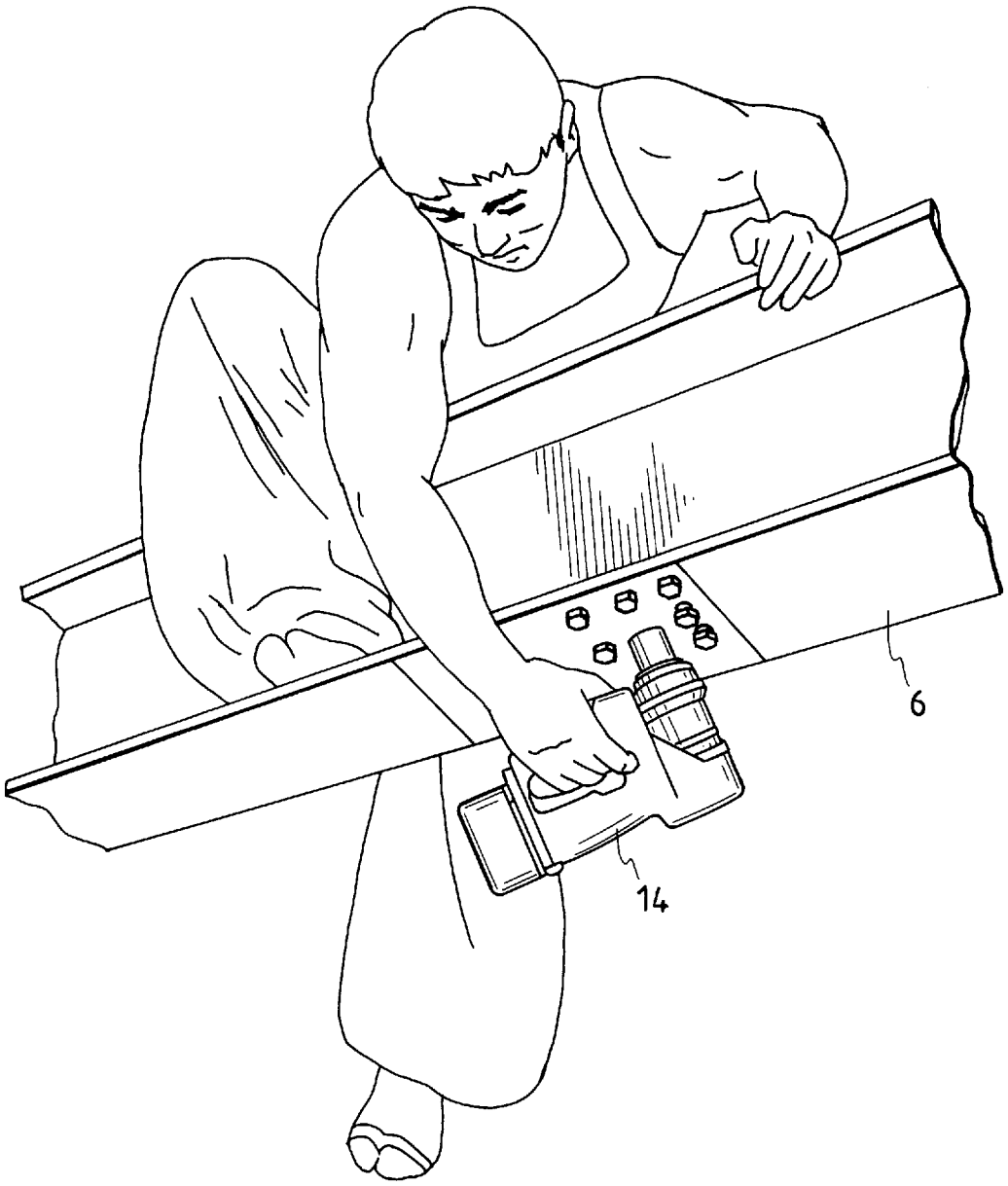
FIG. 8 is a perspective view showing a working style of an operator during a fastening operation of a bolt fastened upward from below by using the shear wrench in accordance with the present invention.
Figure 9:
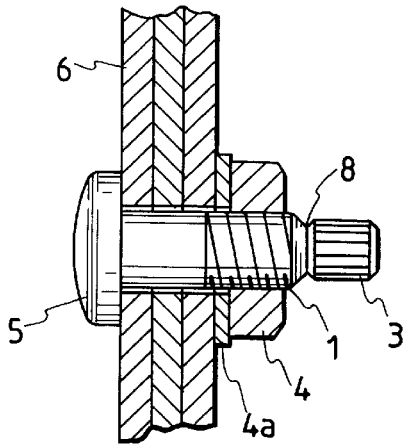
FIG. 9 PRIOR ART
FIG. 9 is a cross-sectional view showing a steel plate assembly fastened by means of a shear bolt.

For an operator of the shear wrench, there is a possibility that the operator is forced to pose for a while to fasten a bolt upward from below as shown in FIG. 8. The weight of a shear wrench is about 5 kg. Supporting such a heavy shear wrench for 10 seconds makes an operator tired or exhausted and worsens the efficiency of the work.

2. The motor housing is too narrow to accommodate both of the motor switch and the chip switch.

During the work shown in FIG. 8, the handle 14 is spaced far from the operator. This forces the operator to support the heavy shear wrench during a series of works including the fastening of a bolt fastening and the expelling of a chip. This makes the operator tired and exhausted.

In this case, it will be easier for the operator to grip the motor housing 24 instead of handle 14 to perform all of the necessary operations.

To realize this, the following things needs to be solved.

(1) Both of the motor switch and the chip switch are disposed near the motor housing. The motor switch needs to have a sufficient durability because the motor switch is subjected to large current equivalent to 30 A. The size of the motor switch is hence increased and a significant space is required for it.

(2) A lead connecting the power source to the motor switch and the motor needs to be thick enough to avoid a power loss. A large space is required for arranging such thick lead.

3. An automatic transmission mechanism may be used for speeding up a no-load rotation of a nut.

To solve the above-described problem that the speed of the cordless shear wrench is slow during a no-load condition, it will be effective to provide an automatic transmission mechanism in an appropriate portion in the speed-reduction gear train, to increase the rotational speed in a no-load condition (i.e., small reduction ratio and lower torque) and reduce the rotational speed in a loaded condition (i.e., large reduction ratio and higher torque).

U.S. Pat. No. 4,215,594 discloses a conventional automatic transmission mechanism applied to fastening tools, according to which a low-torque and high-speed rotation is realized by rotating a planetary gear mechanism entirely while a high-torque and low-speed rotation is realized by stopping an internal gear of the planetary gear train.

Figure 14:
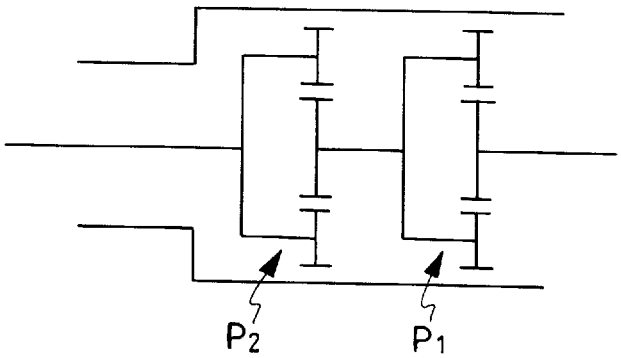
FIG. 14 is a skeleton view schematically showing a gear arrangement of the shear wrench shown in FIG. 12.

FIG. 14 is a schematic gear arrangement of the speed-reduction mechanism of the shear wrench shown in FIG. 12, which consists of two-stage planetary gear trains P1 and P2 with a common internal gear integrally formed at an outer peripheral portion thereof.

Figure 15:
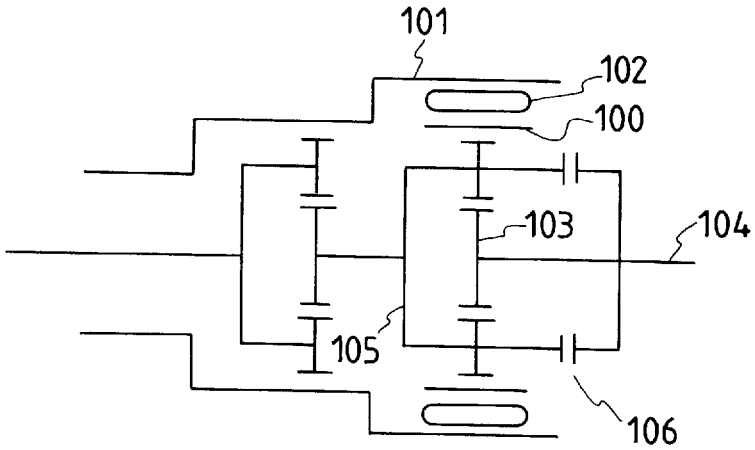
FIG. 15 is a skeleton view schematically showing a gear arrangement including a speed-reduction mechanism incorporated in the shear wrench shown in FIG. 12.

An automatic transmission mechanism is, for example, combined with this speed-reduction mechanism. As shown in FIG. 15, a first-stage internal gear 100 is formed independently of a second-stage internal gear 101. A one-way clutch 102 is disposed outside the internal gear 100. The sun gear 103 is driven by a drive shaft 104. The planetary gear support 105 is selectively engaged or disengaged with the drive shaft 104 via a clutch 106. When a torque applied to the planetary gear support 105 is smaller than a predetermined value, the rotation is directly transmitted via the clutch 106 from the drive shaft 104 to the planetary gear support 105 without any speed reduction. In this case, the internal gear 100 is in an idle-running condition by the function of the one-way clutch 102. When the torque applied to the planetary gear support 105 exceeds the predetermined value, the clutch 106 is disengaged and the rotation of the drive shaft 104 is reduced by the planetary gear and transmitted to the planetary gear support 105. At the same time, a torque acts on the internal gear 100 in the direction opposed to the rotational direction. Accordingly, the one-way clutch 102 is locked. This automatic transmission mechanism has the following problems.

(1) Two internal gears 100 and 101 of the two-stage planetary gear trains need to be made independently. This possibly increases the cost.

(2) The one-way clutch 102 has to endure a large force. The size of the one-way clutch becomes large because the one-way clutch is provided outside a larger-diameter internal gear 100. This further increases the cost. The outer diameter of the speed-reduction section is increased. The weight increases in proportion to the square of the diameter.

(3) The conventional two-stage planetary gear trains cannot be used directly without any modification. There is a necessity of separately manufacturing a gear train with no automatic transmission for a corded shear wrench and a gear train with an automatic transmission for a cordless shear wrench. This leads to the cost increase.

The present invention satisfies the above requirements and solves the problems to be predicted.

Preferred embodiments of the present invention will be explained hereinafter with reference to accompanying drawings. Identical parts are denoted by the same reference numerals throughout the drawings.

Figure 3:
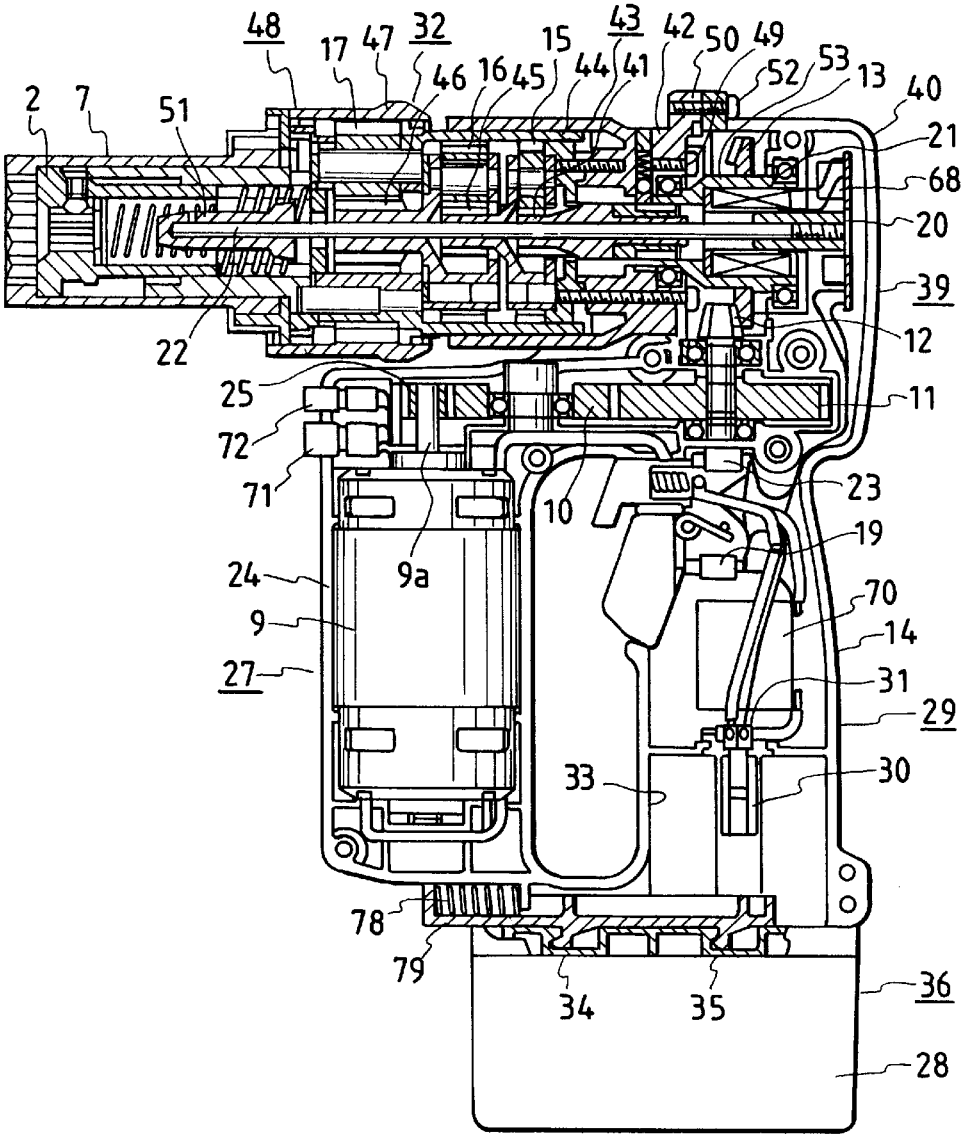
FIG. 3 is cross-sectional view showing an overall arrangement of the cordless shear wrench in accordance with the first embodiment of the present invention.

FIG. 3 shows an overall arrangement of a cordless shear wrench in accordance with a first embodiment of the present invention. A motor 9 has a rotational shaft 9*a* projecting upward in the drawing. A motor pinion 25 is secured to the tip of this rotational shaft 9*a* by press fitting. The motor 9 is accommodated stationarily in a motor housing 24. This section is referred to as "motive power section" 27 hereinafter. A handle 14 extends in parallel with this motor housing 24. A motor switch 19 is disposed in this handle 14. The motor switch 19 opens or closes a power feed circuit connecting the motor 9 to a battery 28. This section is referred to as "handle section" 29 hereinafter.

The battery 28 is connected to the bottom of handle 14 at one (i.e., right) end and to the bottom of motor housing 24 at the other (i.e., left) end. The battery 28 extends horizontally in the drawing so as to bridge or straddle handle 14 and motor housing 24. Terminals 31 are brought into contact with electrodes 30 of the battery 28 at one ends thereof and are connected to the motor switch 19 at other ends thereof.

The battery 28 is located at a position symmetrical to an output mechanism section 32 with respect to the handle 14. The output mechanism section 32 comprises an inner socket 2 and planetary gears that are later described in detail. The handle 14 has a battery bore 33 for receiving an upper protruding part of the battery 28. Thus, the battery 28 is inserted into this bore 33 from below in the drawing and detachably held between latches 34 and 35. The latches 34 and 35 are provided on a slide plate 79 that is slidably urged by a spring 78 and positioned so as to bridge or straddle the handle 14 and the motor housing 24.

Figure 4:
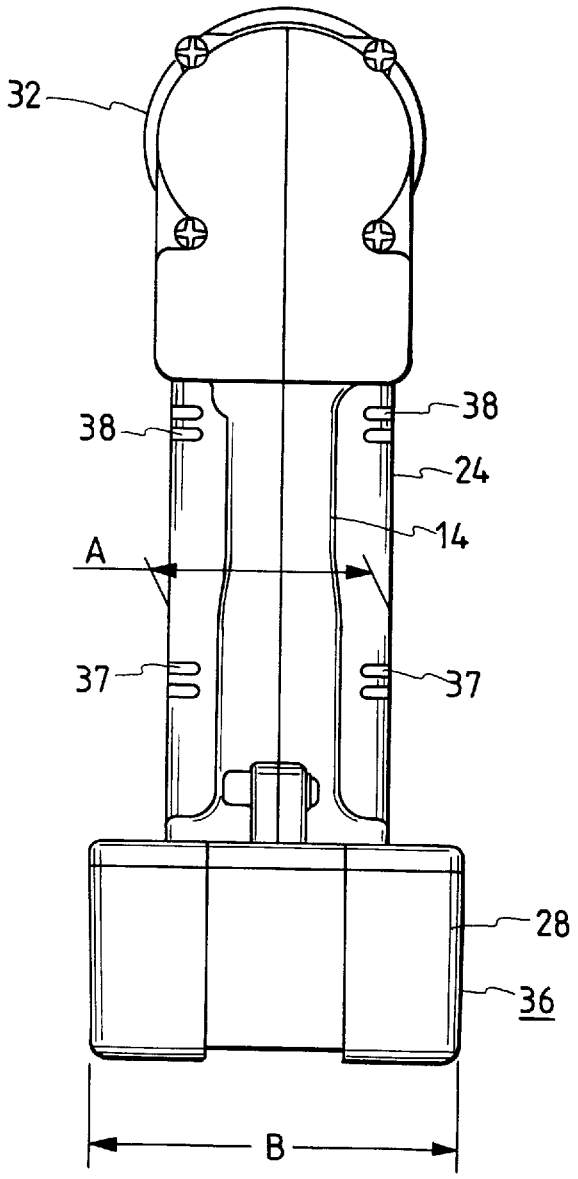
FIG. 4 is a right side view of the cordless shear wrench shown in FIG. 3.

Furthermore, when seen from the front as shown in FIG. 4, the battery 28 has a width B wider than a width A of the motor housing 24 by an amount of about 45 mm. The rear end of battery 28 corresponds to the rear end of the handle 14. The front end of battery 28 corresponds to ⅓ of the bottom of the motor housing 24 from the rear end thereof. This section is referred to as "power feed section" 36.

The motor 9 is provided with a cooling fan (not shown). A plurality of ventilation windows 37, 37 are provided near the battery 28 for introducing fresh air fed to the cooling fan. A plurality of ventilation windows 38, 38 are provided near motor pinion 25 far from the battery 28 for scavenging heated air from the cooling fan. Attaching and detaching directions for the battery 28 to and from the battery bore 33 are perpendicular to a longitudinal direction of the inner socket 2 and parallel to a longitudinal direction of the handle 14.

The output mechanism section 32 has a weight of about 2.5 kg. The battery 28 has a weight of about 1.2 kg. The motor switch 19 is positioned at a grip region of the handle 14 that is held by an operator's hand. The position of motor switch 19 corresponds to ⅓ of the handle 14 from the upper end thereof This position substantially coincides with the center of gravity of the shear wrench body.

When motor switch 19 is closed, a relay 70 is energized to close an associated relay contact and activate the motor 9. The rotation of motor 9 is transmitted to a speed-reduction mechanism section 39. In a gear cover 40 of the speed-reduction mechanism section 39, spur gears 10 and 11 are provided. The speed of motor 9 is first reduced by these spur gears 10 and 11 according to a reduction gear ratio defined by their teeth numbers. A bevel gear 12 is press-fitted in the spur gear 11. This bevel gear 12 is meshed with a bevel gear 13 that has a bevel gear shaft 53 normal to the axis of the bevel gear 12. Thus, the rotation of motor 9 is transmitted to the bevel gear shaft 53 via the bevel gear train. Through the above-described transmission in the speed-reduction mechanism section 39, the rotational speed of motor pinion 25 is reduced to about 1/24.

The rotation of the bevel gear shaft 53 is transmitted to an output mechanism section 43. The output mechanism section 43 comprises three-stage planetary gear trains, an outer socket 7, the inner socket 2 and an inner cover 42. The inner cover 42 fixes the sockets 2 and 7 to the gear cover 40. An operation of the gear train including the bevel gear 13 to a sun gear 41 will be explained later in greater detail with reference to FIGS. 1 and 2.

The rotational speed of the sun gear 41 is successively reduced through first- to third-stage planetary gear trains. The first-stage planetary gear train comprises planetary gears 15 and an internal gear 44. The second-stage planetary gear train comprises a sun gear 45, planetary gears 16 and the internal gear 44. The third-stage planetary gear train comprises a sun gear 46, planetary gears 17 and an internal gear 47.

The internal gear 47 is connected to the outer socket 7. The internal gear 44 is connected to the inner socket 2. The rotational speed of the bevel gear 13 is substantially reduced to 1/100 through the above-described differential speed reduction by the internal gears 44 and 47. The planetary gears 15 and 16 are meshed with the internal gear 44 integrally cut with the same module and same teeth number. The speed-reduction mechanism section 39 and the output mechanism section 43 in combination will be referred to as "output section" 48. Through this output section 48, the rotational speed of motor 9 is reduced to about 1/2,400, and the torque is increased to 500 Nm to wrench off the chip 3 while tightening the nut 4. As a result, the steel plate assembly 6 is fastened with a 500 Nm torque.

The output mechanism section 43 is fixed to the plate-like inner cover 42 by means of six small screws 49. The inner cover 42 has a plurality of threaded holes 50 at its peripheral flange. The gear cover 40 has corresponding threaded holes 50 at its peripheral flange. The inner cover 42 is fixed to the gear cover 40 using four mounting bolts 52 each being inserted into the corresponding threaded holes 50 from outside the gear cover 40.

The wrenched-off chip 3 remains inside the inner socket 2. However, this chip 3 is expelled out of the inner socket 2 in response to a turning-on operation of a chip switch 23 provided in the handle 14 or a chip switch 72 provided at an upper part of the motor housing 24. More specifically, a solenoid coil 21 is disposed in a hollow space formed in the steel bevel gear shaft 53. When the chip switch 23 or 72 is closed, large current of 30 A at 24 V is fed to the solenoid coil 21. With this current feed to the solenoid coil 21, an electromagnetic force is generated from the solenoid coil 21 by the magnitude sufficiently large to attract the plunger 20 toward the center of the solenoid coil 21. An elongated rod 22 extends from the plunger 20 to the left in FIG. 3 along the axial direction of the plunger 20, passing through the output mechanism section 43. A hammer 51 is integrally attached on the tip of rod 22. Thus, the hammer 51 causes a shift movement in the axial direction of the plunger 20 in response to the activation of solenoid coil 21. In other words, the chip 3 remaining within the inner socket 2 is forcibly expelled out of the inner socket 2 by the shift movement of the hammer 51.

Figure 1:
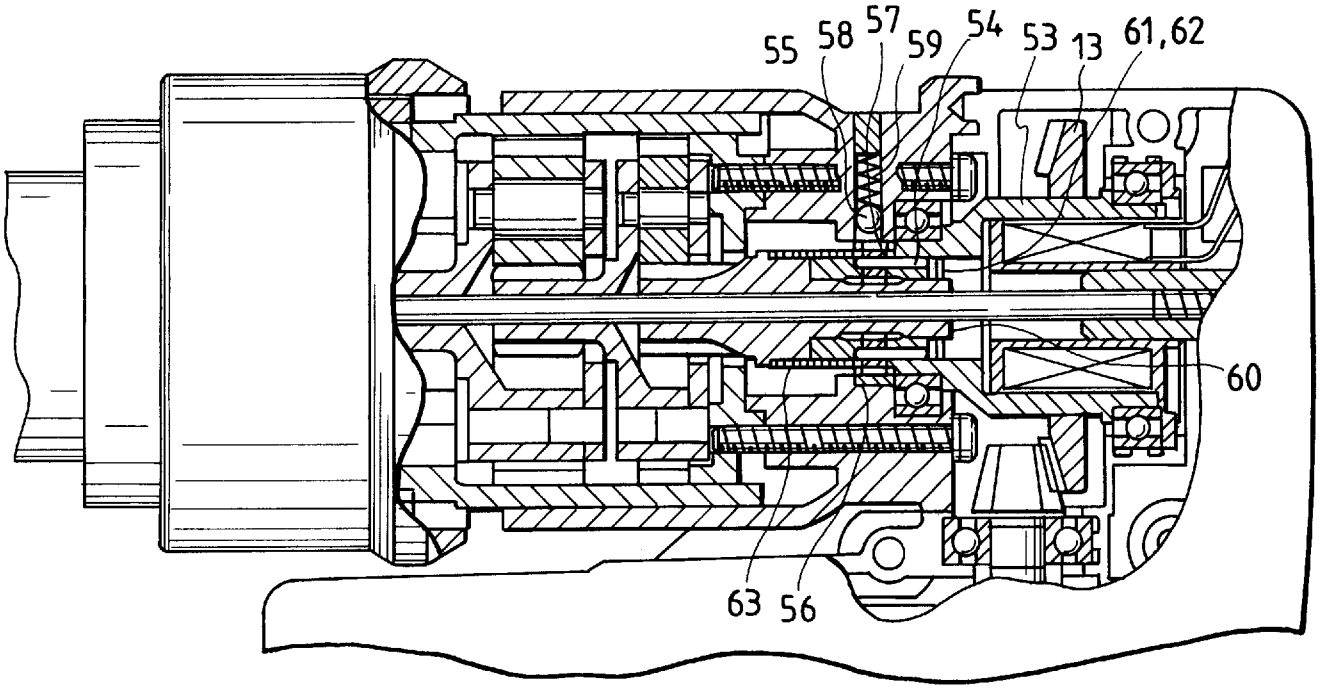
FIG. 1 is a partly cross-sectional view showing an automatic transmission mechanism of a cordless shear wrench in accordance with a first embodiment of the present invention.
Figure 2:
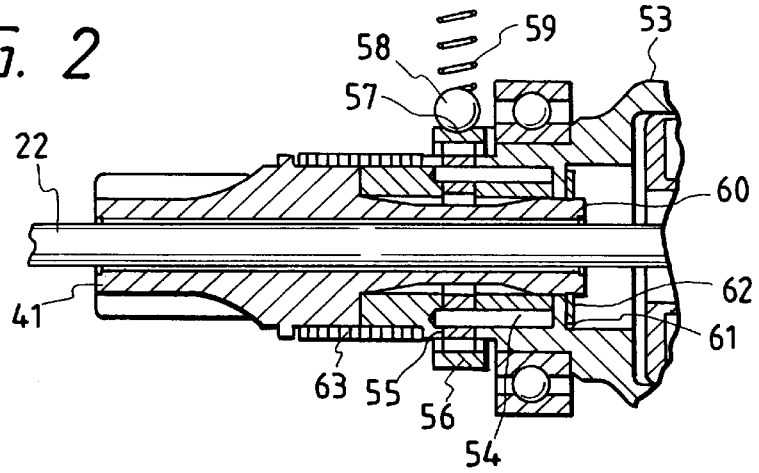
FIG. 2 is an enlarged cross-sectional view showing an essential part of FIG. 1.

FIG. 1 and 2 show detailed arrangement of the gear train ranging from the speed-reduction mechanism section 39 to the output mechanism section 43. An automatic two-stage transmission mechanism is added in series to the output mechanism section 43 shown in FIG. 3.

The bevel gear shaft 53, serving as a rotational shaft of the bevel gear 13, is rotatably supported between two bearings. The distal end of the bevel gear shaft 53 acts as a planetary gear support for holding three planetary gears 55 via pins 54. Planetary gears 55 are meshed with an internal gear 56 surrounding them. The internal gear 56 is rotatably coupled with the inner cover 42. A conical groove 57 is provided at a portion outside the internal gear 56. A ball 58 is placed in this conical groove 57 and urged by a push spring 59, to prevent the internal gear 56 from slipping. This is one of slip clutches capable of determining a slip torque flexibly based on the strength of push spring 59 and an inclination angle of the conical groove 57.

The bevel gear shaft 53 is hollow. Provided inside this hollow space of bevel gear shaft 53 is part of sun gear 41. The rear end of the sun gear 41 is integral with a shaft portion formed into a sun gear 60. Thus, the sun gear 41 and sun gear 60 are rotatably inserted inside the bevel gear shaft 53. To prevent the sun gear 60 from being pulling out in the axial direction, the sun gear 60 is stopped by a washer 61 and a stopper washer 62 provided at the inner end of the sun gear 60.

The main part of sun gear 41 extends out of the hollow space of bevel gear shaft 53. The outer diameter of the main part of sun gear 41 is increased and identical with the outer diameter of the bevel gear shaft 53. A spring clutch 63 is installed around a joint portion of the main part of sun gear 41 and the bevel gear shaft 53. The spring clutch 63 has an interference of 0.5 mm. Thus, the spring clutch 63 straddles the sun gear 41 and the bevel gear shaft 53 and holds them with a predetermined force. The spring clutch 63 is, for example, a coil spring that is a 12-turn, left-hand wind, rectangular wire of about 1×1.5 mm. When the bevel gear shaft 53 rotates in a clockwise direction with respect to the sun gear 41, the spring clutch 63 shrinks in its radial direction and therefore increases the fastening force applied to the bevel gear shaft 53 and the sun gear 41. A larger torque equivalent to 30 Nm can be transmitted in this case. On the other hand, when the bevel gear shaft 53 rotates in a counterclockwise direction with respect to the sun gear 41, the spring clutch 63 expands in its radial direction and therefore reduces the fastening force applied to the bevel gear shaft 53 and the sun gear 41. In this case, a transmittable torque remains in a lower level as small as 0.01 Nm. Thus, the spring clutch 63 serves as a one-way clutch.

Figure 16:
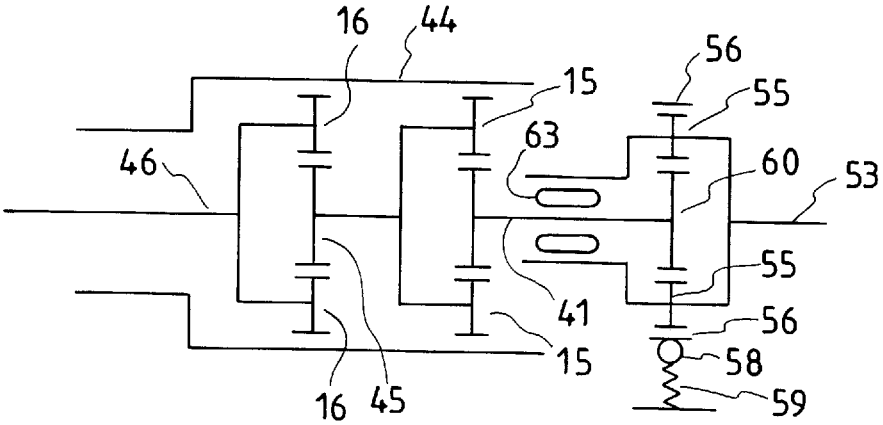
FIG. 16 is a skeleton view schematically showing a gear arrangement of a shear wrench in accordance with the present invention.

FIG. 16 is a skeleton view schematically showing the above-described gear arrangement of the shear wrench in accordance with the present invention.

Next, an operation of the cordless shear wrench in accordance with the present invention will be explained.

It is now assumed that the nut 4 is positioned at a position corresponding to a floating amount equivalent to one screw thread. When the steel plate assembly 6 is fastened by the bolt 1, a torque required for rotating nut 4 in such an idle condition is very small (about 0.005 Nm). Thus, the motor 9 is substantially in a no-load condition. The bevel gear shaft 53 rotates at a speed equivalent to 1,000 rpm.

According to the shear wrench shown in FIG. 12, the rotation of the bevel gear shaft 53 is reduced by the output mechanism. The outer socket 7 rotates slowly at a speed of about 10 rpm. It takes six seconds to rotate an amount equivalent to one screw thread. However, according to the present invention, the internal gear 56 is fixed by the ball 58. In this condition, the planetary gears 55 are driven by the bevel gear shaft 53 at a rotational speed Na. The sun gear 60 rotates at an increased speed $Ns=(Zr/Zs+1)\times Na$, where Zr represents the teeth number of the internal gear 56, and Zs represents the teeth number of the sun gear 60. According to the embodiment of the present invention, the practical speed of the sun gear 60 is 3,200 rpm, that is about 3.2 times as large as the above-described rotational speed of the bevel gear shaft 53.

The sun gear 41 coaxial and integral with the sun gear 60 rotates in the clockwise direction at the speed Ns (i.e., 3,200 rpm). The bevel gear shaft 53 rotates in the clockwise direction at the speed Na (1,000 rpm). In other words, the bevel gear shaft 53 rotates in the counterclockwise direction with respect to the sun gear 41 at a relative speed equivalent to $(Ns-Na)=2{,}200$ rpm. Thus, the spring clutch 63 expands in its radial direction. The fastening force applied to the bevel gear shaft 53 and the sun gear 41 is reduced in this case. In other words, the spring clutch 63 serves as a one-way clutch. Thus, the rotation of the bevel gear shaft 53 is not directly transmitted to the sun gear 41. Instead, the rotation of the bevel gear shaft 53 is transmitted via another path of planetary gears 55 and sun gear 60 to the sun gear 41.

The rotational speed of the bevel gear shaft 53 is increased to a higher speed by the planetary gears 55 and the sun gear 60. This rotational speed is reduced to 1/100 by the output mechanism section 43. Thus, the rotational speed finally transmitted to the outer socket 7 is 32 rpm that is about 3.2 times as large as that of the conventional shear wrench. With this increased speed, the time required for feeding one screw thread can be reduced to about 2 seconds.

A torque acting in this case is very small and about $5\times10^{-5}$ Nm that is equivalent to a division of the above-described 0.005 Nm by the speed-reduction ratio. Thus, the internal gear 56 and the planetary gears 55 can be downsized significantly. This makes it possible to fabricate the internal gear 56 and planetary gears 55 by using a simple and non-expensive method such as a sintering or the like. Furthermore, the planetary gears 55, the internal gear 56 and the sun gear 60, cooperatively constituting a speed-increasing gear train, have a large degree of freedom in determining a gear ratio for speed increase, because there is no mutual action in a coupled condition. Moreover, the size in the radial direction and the weight can be reduced due to no necessity of providing a one-way clutch around the internal gear.

After completing a predetermined amount of free rotation of the nut 4, the nut 4 tightly abuts the steel plate assembly 6. Thereafter, the nut 4 is fastened under a loaded condition. A fastening torque increases linearly in proportion to the rotational angle of nut 4. The transmission torque Ta of bevel gear shaft 53 is increased too. When the rotation is transmitted via planetary gears 55, a torque Tr is caused as a reaction force acts on the internal gear 56. As is well known, the torque Tr is expressed by the following equation.

$$Tr=(Zr/Za)\times Ta$$

Thus, the torque Tr increases in proportion to the torque Ta. The torque Tr may exceed the slip torque of the slip clutch that is determined by the ball 58 and the push spring 59. In this case, the internal gear 56 starts slipping, while a speed-increasing function is reduced or lost. Thus, the planetary gears 55 and the sun gear 60 rotate integrally at the same rotational speed. The torque transmitted via this transmission path does not exceed a value corresponding to the slip clutch. The bevel gear shaft 53 rotates with respect to the sun gear 41 at a constant or lower speed. The spring clutch 63 shrinks in its radial direction and therefore increases the fastening force applied to the bevel gear shaft 53 and the sun gear 41. Thus, the rotational speed Na of bevel gear shaft 53 is directly transmitted to the sun gear 41. The rotation of sun gear 41 is then reduced by the output mechanism section 43, and is finally transmitted to the nut 4 with a large torque.

According to the above-described embodiment of the present invention, the output mechanism section 43 has the same arrangement as that of the previously proposed shear wrench. More specifically, no modification is added to the internal gears 44 and 47, planetary gears 15–17, and the planetary gear support of the three-stage planetary gear trains in the output mechanism section 43, compared with the gear train of the previously-proposed shear wrench. Especially, the internal gear 44 is not divided for the first and second sages. This is advantageous in that the gear train can be directly used without any modifications, bringing a significant reduction in manufacturing costs.

According to the above-described embodiment of the present invention, the speed change from a high-speed mode to a low-speed mode is automatically done by the slip clutch sensitive to a torque acting on the shaft in the torque transmitting path. Due to a high torque during the low-speed mode, the internal gear 56 causes a slip against the pressing force given from the ball 58 urged by the push spring 59. However, a dynamic torque is largest at the start of slipping, when a combination of ball 58 and push spring 59 is used. Once the slipping condition is stabilized, the dynamic torque is reduced to ½ to ⅓ compared with that at the start of the slipping phenomenon. Accordingly, the loss during the slipping condition can be suppressed in a range of ½ to ⅓.

Figure 5:
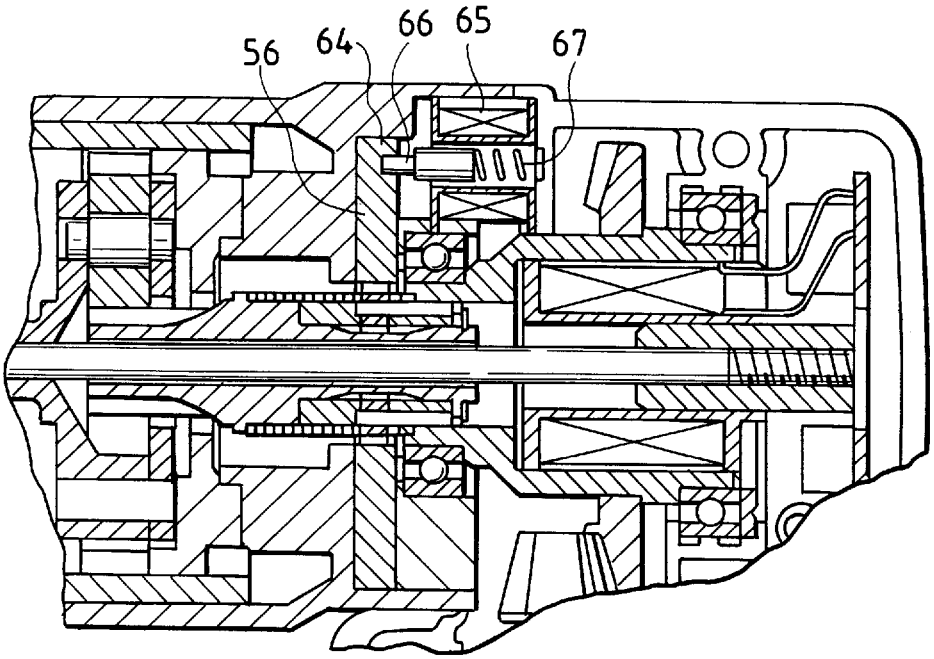
FIG. 5 is a cross-sectional view showing an essential part of the gear arrangement in accordance with a second embodiment of the present invention.
Figure 6:
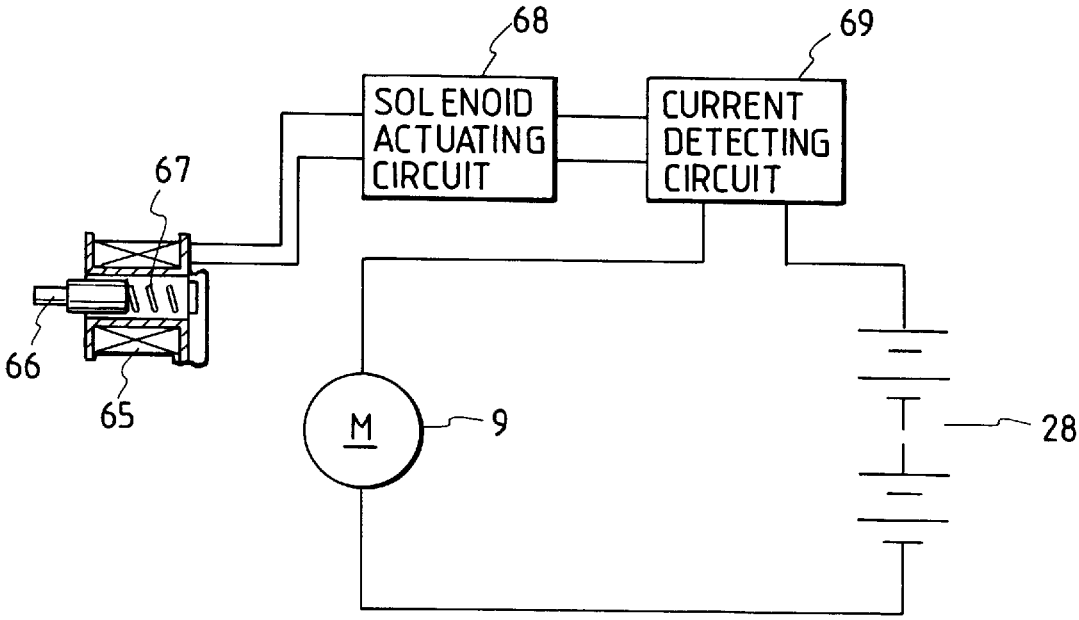
FIG. 6 is a circuit diagram showing a circuit for an electric component shown in FIG. 5.

FIGS. 5 and 6 cooperatively show another shear wrench in accordance with a second embodiment of the present invention. The second embodiment is characterized in that the switching between the high-speed mode and the low-speed mode is electrically detected. The second embodiment is identical in the gear arrangement with the first embodiment, but is different in the following arrangement newly added. A cutout (i.e. recessed portion) 64 is provided at the peripheral edge of the internal gear 56. A solenoid coil 65 is provided near the cutout 64. A rod 66 is slidably inserted in the axial bore of the solenoid coil 65. A push spring 67 urges the rod 66 toward the internal gear 56, so that the distal end of rod 66 is engaged with or locked in the cutout 64 at the most-extended position thereof. In other words, the internal gear 56 is locked by the rod 66 when the solenoid coil 65 is deactivated. The solenoid coil 65 is turned on or off by a solenoid actuating circuit 68. In response to the activation of solenoid coil 65, rod 66 is attracted toward the inside of the solenoid coil 65 against the resilient force of the push spring 67. Thus, the rod 66 is disengaged from the cutout 64, letting the internal gear 56 be rotatable freely.

A current detecting circuit 69 detects current flowing across the motor 9 and produces an output signal when the detected current exceeds a predetermined value. The solenoid actuating circuit 68 receives the output signal of the current detecting circuit 69, and activates the solenoid coil 65 in response to the output signal of the current detecting circuit 69.

When the nut 4 is rotating freely, a load acting on motor 9 is very small and the current is small (about 2 A). Thus, the current detecting circuit 69 does not produce any output signal. The solenoid coil 65 is not activated. The internal gear 56 is held in a locked condition. The rotational speed of the planetary gears 55 is increased by the sun gear 60 with an amplification factor of about 3.2 that is equivalent to the gear ratio. Thus, the outer socket 7 is fast fed at a higher speed.

After completing a predetermined amount of no-load rotation of the nut 4, the nut 4 tightly abuts the steel plate assembly 6 and is fastened under a loaded condition. The current flowing through the motor 9 increases. When the current exceeds 5 A, the solenoid coil 65 is energized to disengage the rod 66 from the internal gear 56. Thus, the locking condition is released between the rod 66 and the internal gear 56. The internal gear 56 starts rotating freely. No torque is transmitted from the planetary gears 55 to the sun gear 60. Hence, as described above, the rotation of bevel gear shaft 53 is transmitted to the sun gear 41 via the spring clutch 63. The sun gear 41 rotates at a lower speed and fastens the nut 4 with a larger torque. In this case, the internal gear 56 is free from a frictional torque acting from the push spring 59 and ball 58. No rotational loss is thus caused. Furthermore, the rotation is basically silent because of no collision of ball 58.

The second embodiment shown in FIGS. 5 and 6 basically depends on a relationship that a load current is proportional to a torque. In this respect, a torque is reverse proportional to a rotational speed. Thus, it is possible to detect a rotational speed of an adequate portion of a rotating shaft to control the system instead of detecting the load current. Furthermore, it is possible to dispose a spring (not shown) capable of sensing the torque itself. This spring causes a deflection in proportion to a sensed torque. When a deflection amount of the spring exceeds a predetermined value, an associated micro switch (not shown) is turned on to control the solenoid coil 65. Detecting a rotational speed or a torque is advantageous in that the arrangement for a sensing device can be simplified.

Figure 17A:
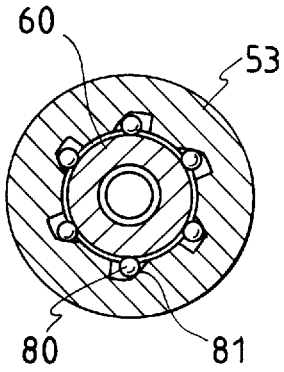
Figure 17B:
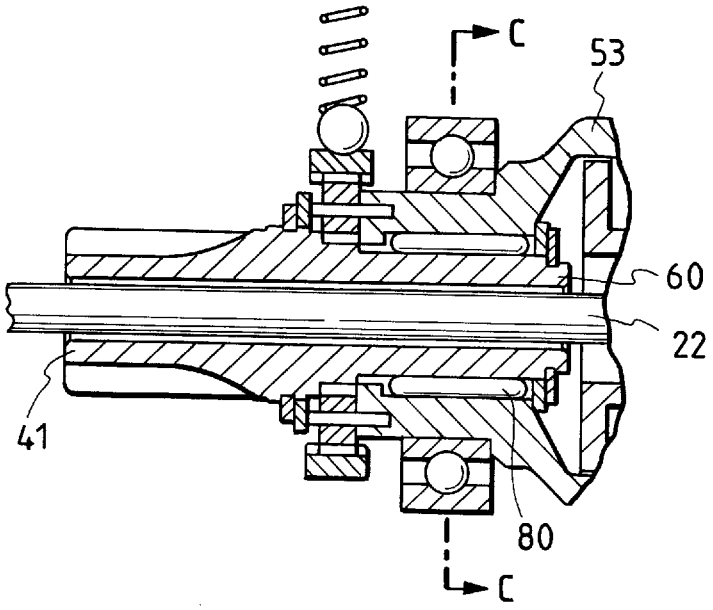

The spring clutch 63 used in the above-described embodiment can be replaced by a needle type one-way clutch shown in FIGS. 17A and 17B. This one-way clutch mechanism is constituted by six needles 80 and corresponding slant surfaces 81. The arrangement of this needle type one-way clutch is advantageous in that an overall axial size is reduced because the drive shaft and the driven shaft can be confronted in the radial direction, not in the axial direction.

Figure 18:
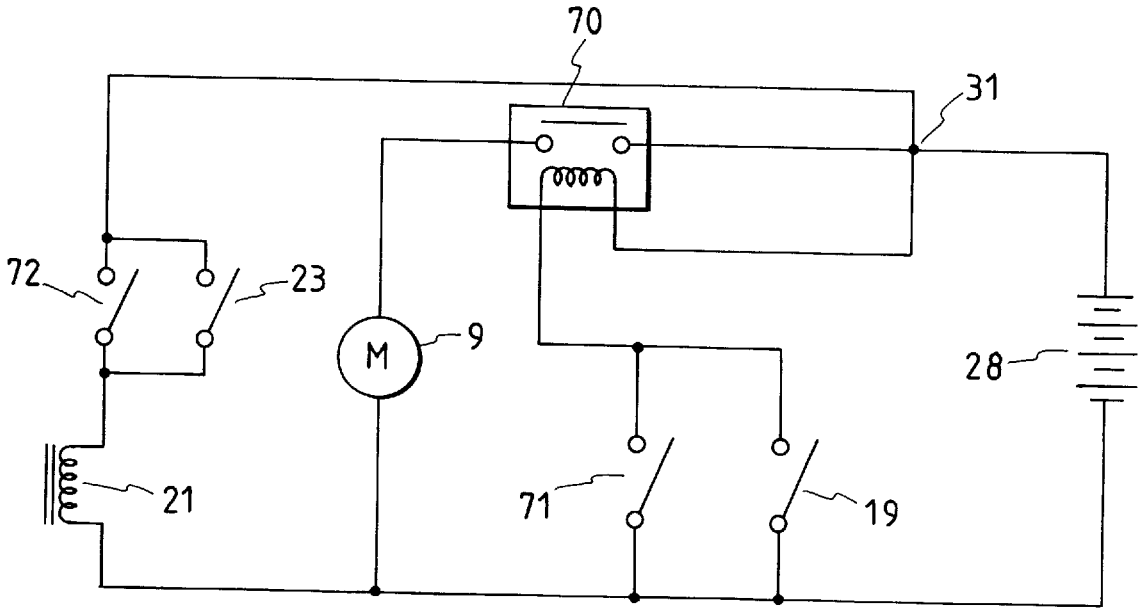
FIG. 18 is a circuit diagram showing an actuation circuit for a shear wrench in accordance with the present invention.

Two motor switches 19 and 71 and two chip switches 23 and 72 are provided as shown in FIG. 3. Motor switch 19 and chip switch 23 are provided in the handle 14, while motor switch 71 and chip switch 72 are provided in the motor housing 24. The power feed section 36 comprises the battery 28 disposed beneath the handle 14. The terminal 31, brought into contact with the electrode 30 of the battery 28, is connected to the relay 70 and chip switches 23 and 72 as shown in FIG. 18. Motor switches 19 and 71, selectively activating or deactivating the relay 70, are disposed above the relay 70 and motor 9, respectively. Chip switches 23 and 72 are disposed in the same manner as the motor switches 19 and 71.

According to the circuit shown in FIG. 18, the load current of the motor 9 does not flow directly through the motor switches 19 and 71. The current flowing through the motor switches 19 and 71 is about 0.3 A that is very small compared with the load current (about 30 A) of the motor 9. Thus, the motor switches 19 and 71 can be constituted by a micro switch that has smaller capacity and size. Furthermore, due to small current, thin leads can be used to connect the motor switches 19 and 71 to relay 70 and battery 28. Practically, the leads can be downsized from 2 $mm^2$ to 0.2 $mm^2$.

On the other hand, chip switches 23 and 72 are subjected to large current equivalent to 30 A. However, the duration of this large current is about 10 msec that is considerably short. The chip switches 23, 72 and their leads can be downsized. Thus, both of the chip switch 72 and the motor switch 71 are smoothly installed in a limited space above the motor 9 in the motor housing 24. The motor housing 24 can be made slender, so that the motor housing 24 can be gripped by an operator's hand. This makes it possible to improve the handling of the shear wrench during a work, even in the fastening operation shown in FIG. 8 wherein steel plates are tightened by a bolt fastened upward from below.

Figure 7:
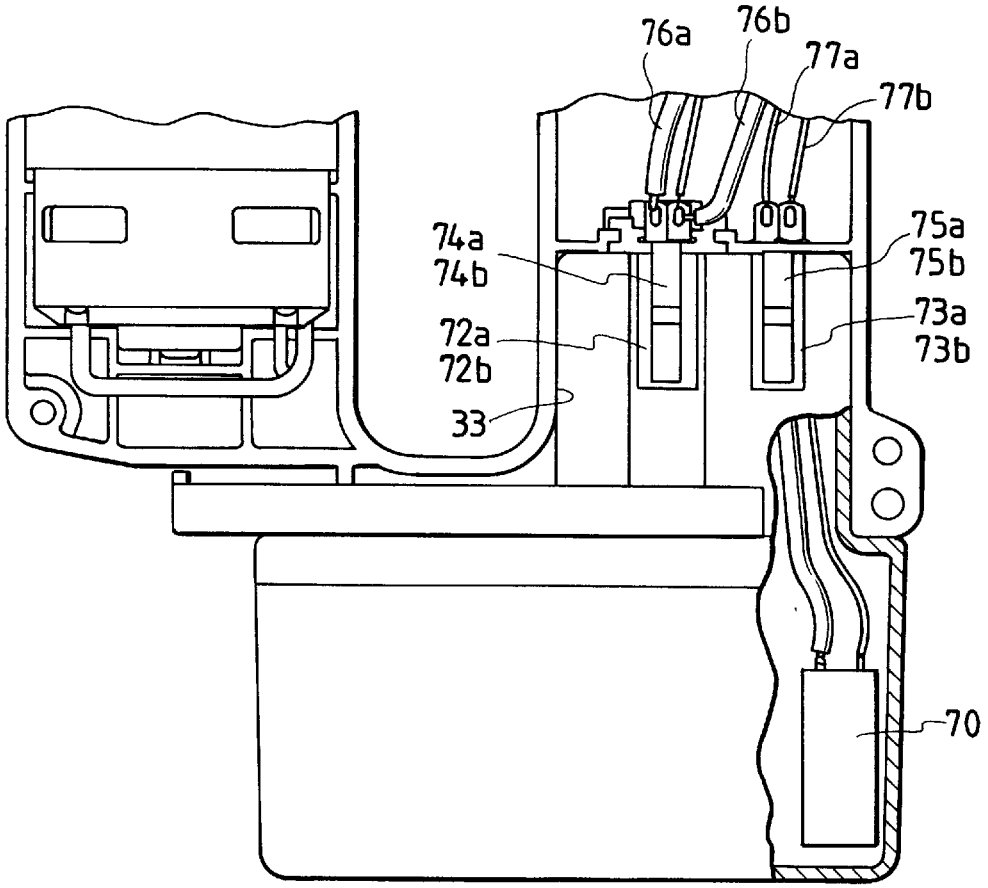
FIG. 7 is a partly cross-sectional view showing a third embodiment of the present invention.

FIG. 7 is a partly cross-sectional view showing a third embodiment of the present invention, different from the above-described embodiments in the arrangement of the battery 28 that accommodates the relay 70 integrally. More specifically, the battery bore 33 in the handle 14 is provided with electrodes 72*a*, 72*b*, 73*a* and 73*b* that are brought into contact with terminals 74*a*, 74*b*, 75*a* and 75*b* of the battery 28. The electrodes 72*a* and 72*b* are connected to the motor 9 and the relay 70 via thick leads 76*a* and 76*b*, respectively. The electrodes 73*a* and 73*b* are connected to the relay 70, switches 19, 23, 71 and 72 via thin leads 77*a* and 77*b*, respectively.

According to this embodiment, the length of the leads connecting the battery 28 and the relay 70 can be shortened. This is effective to save the time in its assembling operation.

In the above-described embodiments, the present invention was explained based on a cordless shear wrench. However, it is possible to apply the present invention to a corded shear wrench. Similar effects can be obtained.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within the metes and bounds of the claims, or equivalents of such metes and bounds, are therefore intended to be embraced by the claims.

What is claimed is:

1. A cordless shear wrench comprising:

a motor driven by a battery;

a speed-reduction gear train and a plurality of planetary gear trains reducing the rotational speed of said motor;

socket means for rotating and fastening a bolt with an associated nut by a torque transmitted by said speed-reduction gear train and said plurality of planetary gear trains;

a speed-increasing gear mechanism disposed in a gear arrangement connecting said motor and said socket means, said speed-increasing gear mechanism having an input member and an output ember connected via a one-way clutch; and a clutch mechanism provided to allow a slip at a predetermined portion in said speed-increasing gear mechanism when a load exceeds a predetermined value, thereby transmitting no torque to said output member from said input member through said speed-increasing mechanism.

2. The cordless shear wrench in accordance with claim 1, wherein said speed-increasing gear mechanism is interposed between a final stage gear of said speed-reduction gear train and a first stage planetary gear train of said plurality of planetary gear trains.

3. The cordless shear wrench in accordance with claim 2, wherein said speed-increasing gear mechanism is constituted by a planetary gear mechanism comprising planetary gears supported by a drive shaft of the final stage gear of said speed-reduction gear train, and a sun gear formed integral with a sun gear of said first stage planetary gear train, and said sun gear serves as said output member of said speed-increasing mechanism.

4. The cordless shear wrench in accordance with claim 3, wherein said one-way clutch is a spring clutch having one end engaged with said drive shaft and the other end engaged with said sun gear of said first stage planetary gear train.

5. The cordless shear wrench in accordance with claim 3, wherein said clutch mechanism comprises a ball brought into contact with an outer periphery of an internal gear of the planetary gear mechanism constituting said speed-increasing gear mechanism, and a push spring resiliently urging said ball toward said internal gear.

6. The cordless shear wrench in accordance with claim 3, wherein said clutch mechanism comprises a rod engageable with a recess formed on an internal gear of the planetary gear mechanism constituting said speed-increasing gear mechanism, a spring urging said rod toward said recess, and a solenoid coil disengaging said rod from said recess against a resilient force of said spring.

7. The cordless shear wrench in accordance with claim 6, wherein said solenoid coil is activated in response to a predetermined value of current flowing across said motor, or a predetermined value of a torque or a rotational speed of any one selected from the group consisting of said motor, said speed-reduction gear train and said plurality of planetary gear trains.

8. A cordless shear wrench comprising:

a handle having a lower part configured into a bore for receiving a battery and a hollow space for accommodating a first motor switch therein for opening or closing a power feed circuit connecting a motor and said battery;

a motor housing disposed in front of said handle and extending parallel to said handle for accommodating said motor therein;

a gear cover disposed above said handle and said motor housing and accommodating a speed-reduction gear train therein;

an output mechanism section provided in front of said gear cover and comprising a plurality of planetary gear trains;

an inner socket and an outer socket holding and fastening a bolt and an associated nut by using a torque transmitted from said output mechanism section; and a relay provided between said motor and said battery, said relay being energized or deenergized by said first motor switch and a second motor switch connected in parallel with each other, and said second motor switch being provided in said motor housing.

9. A shear wrench comprising:

a motor;

a speed-reduction gear train and a plurality of planetary gear trains reducing the rotational speed of said motor;

socket means for rotating and fastening a bolt with an associated nut by using a torque transmitted by said speed-reduction gear train and said plurality of planetary gear trains;

a speed-increasing gear mechanism disposed in a gear arrangement connecting said motor and said socket means, said speed-increasing gear mechanism having an input member and an output ember connected via a one-way clutch; and a clutch mechanism provided to allow a slip at a predetermined portion in said speed-increasing gear mechanism when a load exceeds a predetermined value, thereby transmitting no torque to said output member from said input member through said speed-increasing mechanism.

* * * * *